US006691502B2

(12) United States Patent
Wassenhoven

(10) Patent No.: US 6,691,502 B2
(45) Date of Patent: Feb. 17, 2004

(54) OPENING CYLINDER FOR AN OPEN-END SPINNING DEVICE

(75) Inventor: Heinz-Georg Wassenhoven, Mönchengladbach (DE)

(73) Assignee: W. Schlafhorst AG & Co. (DE)

( * ) Notice: Subject to any disclaimer, the term of this patent is extended or adjusted under 35 U.S.C. 154(b) by 162 days.

(21) Appl. No.: 10/000,931

(22) Filed: Nov. 2, 2001

(65) Prior Publication Data

US 2002/0053847 A1 May 9, 2002

(30) Foreign Application Priority Data

Nov. 4, 2000 (DE) ..... 100 54 697

(51) Int. Cl.[7] ..... D01H 4/08
(52) U.S. Cl. ..... 57/408
(58) Field of Search ..... 57/400, 404, 408, 57/410, 412, 112; 19/112, 114; 492/16, 30, 32, 45, 60

(56) References Cited

U.S. PATENT DOCUMENTS

| | | | | | |
|---|---|---|---|---|---|
| 4,196,496 | A | | 4/1980 | Stauffer et al. | 19/97 |
| 4,300,265 | A | | 11/1981 | Heinen | 19/112 |
| 4,679,390 | A | * | 7/1987 | Stewart | 57/408 |
| 4,715,177 | A | | 12/1987 | Stahlecker | 57/408 |
| 4,868,952 | A | * | 9/1989 | Buess et al. | 19/112 |
| 5,085,047 | A | * | 2/1992 | Hofmann | 57/408 |
| 5,196,747 | A | * | 3/1993 | Kress et al. | 310/89 |
| 5,461,464 | A | * | 10/1995 | Swain | 399/159 |
| 5,689,946 | A | | 11/1997 | Schmid | 57/408 |
| 5,709,074 | A | * | 1/1998 | Stahlecker | 57/408 |
| 5,800,088 | A | * | 9/1998 | Luckhof et al. | 403/349 |
| 5,906,567 | A | * | 5/1999 | Gautier | 492/16 |
| 6,101,805 | A | * | 8/2000 | Wassenhoven | 57/408 |

FOREIGN PATENT DOCUMENTS

| | | | | |
|---|---|---|---|---|
| DE | 27 52 591 A1 | | 11/1977 | |
| DE | 33 36 327 A1 | | 4/1985 | |
| DE | 40 36 017 A1 | | 7/1991 | |
| DE | 197 12 880 A1 | | 10/1998 | |
| DE | 197 43 745 A1 | | 4/1999 | |
| DE | 19915251 A1 | * | 10/2000 | D01H/4/32 |
| JP | 11181635 A | * | 7/1999 | D01H/4/32 |

OTHER PUBLICATIONS

European Search Report.
German Search Report.

* cited by examiner

*Primary Examiner*—John J. Calvert
*Assistant Examiner*—Shaun R Hurley
(74) *Attorney, Agent, or Firm*—Kennedy Covington Lobdell & Hickman, LLP

(57) ABSTRACT

An opening cylinder (1) for an open-end spinning device with a detachably fixed opening ring (2) which can be fixed by a torque-free rapid tension device (7) in a readily replaceable manner on a rotatably supported structural component of an opening cylinder (1) driven by an opening cylinder drive (4).

9 Claims, 4 Drawing Sheets

OPENING CYLINDER FOR AN OPEN-END SPINNING DEVICE

CROSS-REFERENCES TO RELATED APPLICATIONS

This application claims the benefit of German patent application 10054697.8 filed Nov. 4, 2000, herein incorporated by reference.

BACKGROUND OF THE INVENTION

The present invention relates generally to an open-end spinning device and, more particularly, to an opening cylinder for an open-end spinning device wherein a ring of opening teeth is detachably fixed about the body of the opening cylinder.

Such opening cylinders for open-end spinning devices are known in various embodiments and are described, e.g., in German Patent Publication DE 197 12 880 A1.

Moreover, German Patent Publication DE 40 36 017 A1 teaches an opening cylinder whose toothed opening ring is arranged directly on an outwardly disposed rotor of an electric drive. More specifically, the toothed opening ring is fixed on the rotatably mounted outside rotor of an opening-cylinder drive by means of a tension unit.

Such a tension unit has been thoroughly proven in the machine-building industry, and in particular makes possible a reliable fixation of a toothed opening ring on a rotatably mounted structural component that can not be secured against rotation during the mounting of the toothed opening ring, while the tension unit also permits the opening ring to be detached, if necessary. However, such a tension unit is a relatively complicated and expensive construction element.

Moreover, the replacement of a toothed opening ring is relatively difficult and time-consuming when using such a tension unit because the individual tightening screws of the tension unit must first be loosened by an appropriate tool and then subsequently re-tightened after the mounting of a new toothed opening ring.

SUMMARY OF THE INVENTION

In view of the above described state of the art, the present invention seeks to address the problem of providing an opening cylinder for an open-end spinning device in which the toothed opening ring can be readily and smoothly fixed on a freely rotatable structural component of the opening cylinder.

The invention addresses this problem by providing an opening cylinder for an open-end spinning device which basically comprises an opening cylinder drive having a driven structural component supported for free rotation, an opening ring, and a torque-free rapid tension device for detachably securing the opening ring in a readily replaceable manner about the structural component.

The torque-free rapid tension device of the present invention has the particular advantage that it also makes possible a smooth replacement of a toothed opening ring if the structural component receiving the toothed opening ring is mounted in a freely rotatable manner and, particularly, cannot be fixed against rotation. In addition, the torque-free rapid tension device of the invention represents a very economical and reliable fastening means that does not require the use of any tool.

Such a torque-free rapid tension device can be embodied with particular advantage, for example, in an open-end spinning device utilizing a so-called outside rotor as the opening cylinder drive, particularly when the toothed opening ring is to be fixed directly on the outside rotor of the drive whose freely rotatable mounting cannot be fixed against rotation for purposes of the installation of the ring.

In a preferred embodiment, the torque-free rapid tension device comprises two eccentric clamps that load a spring element, preferably a plate spring. The plate spring is supported on a flanged wheel of the opening cylinder and acts to apply an axial force to the flanged wheel. This axial force assures that the toothed opening ring is reliably fixed between the flanged wheel and an annular shoulder on the outside rotor of the opening cylinder drive.

Each of the eccentric clamps preferably comprises a manually operable actuation flap as well as at least one eccentrically mounted clamping body. Eccentric clamps designed in this manner can be operated without the use of a special tool, as already indicated previously, and exert such a sufficient pressure on the plate spring on account of their translation in their work position that the plate spring is deformed.

The eccentric clamps are connected via a pivot shaft to a bolt that, in turn, can be fixed via a catch device, such as a bayonet catch or a slide catch, to the outside rotor of the electric drive. Such a catch device constitutes a fastening means that is simple yet reliable during operation and can be loosened without problems at any time in case of need, especially in embodiments utilizing mating projections and grooves. The actuation flaps arranged on the eccentric clamps are protected in the operating state of the opening cylinder in a central recess of the flanged wheel. Such a design of the eccentric clamps assures not only an optimal protection of operating personnel, especially if the central recess is closed with a cover flap (not shown in the exemplary embodiment described hereinafter), but the actuation flaps of the eccentric clamps can also be accessed without problems when needed. Specifically, in order to disengage and detach the torque-free rapid tension device, the actuation flap merely need be folded upwardly and then the bolt of the torque-free rapid tension device fixed by the catch device is rotated, e.g., by about 45 degrees counterclockwise.

Further details of the invention will be understood from the following description of an exemplary embodiment with reference to the accompanying drawings.

DESCRIPTION OF THE PREFERRED EMBODIMENT

Figure 1:
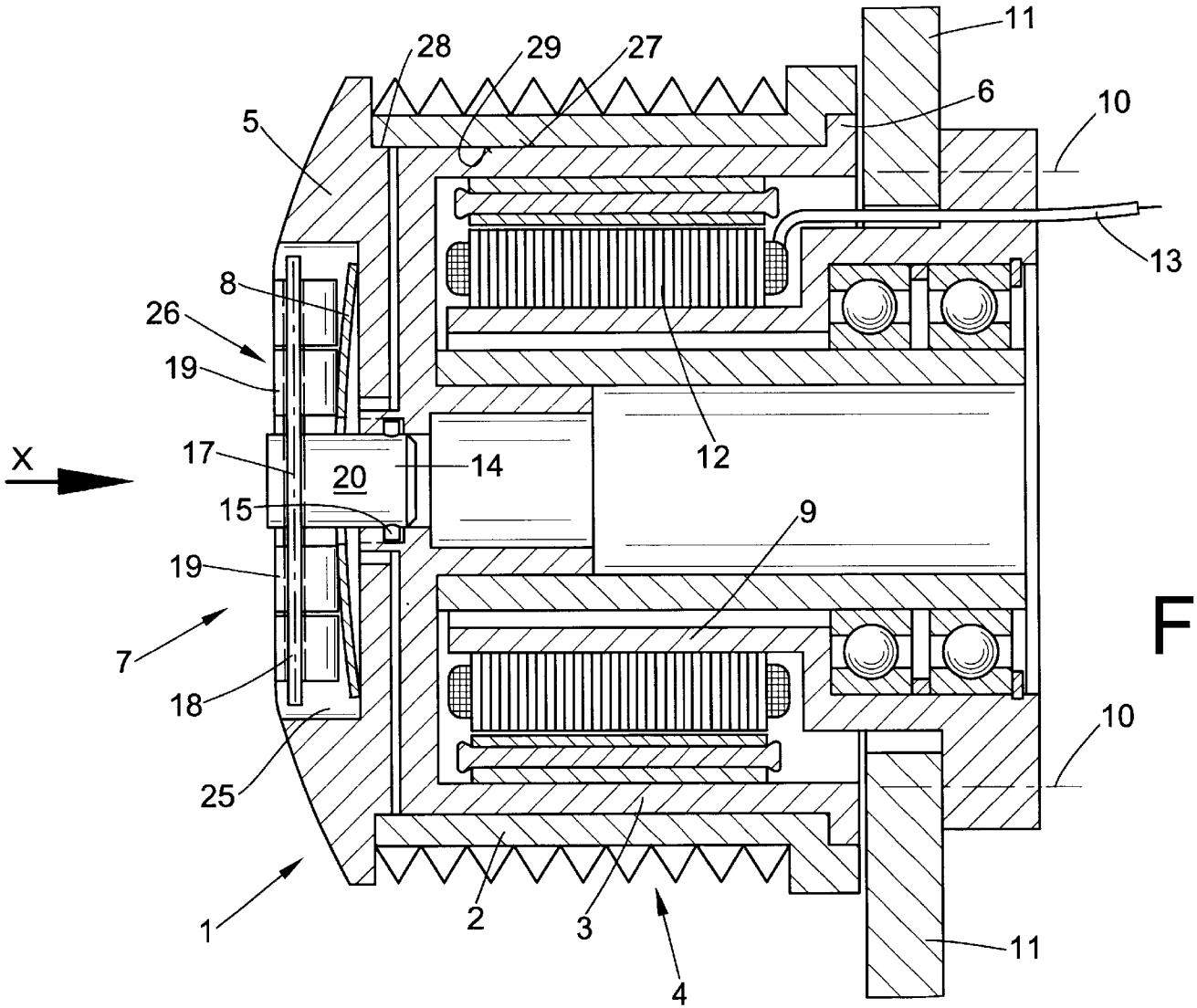
FIG. 1 is an axial cross-sectional view of an opening cylinder for an open-end spinning machine wherein the toothed opening ring is arranged on the outside rotor of an electric drive and is fixed by a torque-free rapid tension device in accordance with the present invention.

Referring now to the accompanying drawings and initially to FIG. 1, an opening cylinder 1 is mounted on an electric drive 4 in the form of a so-called outside rotor drive wherein a stator 9 is fixedly connected via appropriate fastening means, e.g., screw bolts 10, to an opening cylinder housing 11 and is radially outwardly surrounded by a rotor 3 commonly referred to as an outside rotor.

The winding 12 of the stator 9 of opening cylinder drive 4 is connected via an energy lead 13 to an energy source (not shown). Moreover, a toothed opening ring 2 of opening cylinder 1 is replaceably fixed on the outer circumference 27 of the rotor 3 of electric drive 4. More specifically, the toothed opening ring 2 is fixed between a flanged wheel 5 and an annular shoulder 6 of the outside rotor 3 and is loaded by flanged wheel 5 in the axial direction. The flanged wheel 5 is connected to outside rotor 3 via a torque-free rapid tension device 7 that acts on a plate spring 8.

The flanged wheel 5 and opening ring 2 can also be designed as a mounting unit wherein a centering shoulder 28 of flanged wheel 5 and the inside diameter 29 of the toothed opening ring 2 are coordinated with one another to form a snug fit that assures that these components can be assembled and disassembled as a common unit. The fittings ring 2 and the flanged wheel 5 can be preliminarily connected to each other in an earlier work step.

Figure 2:
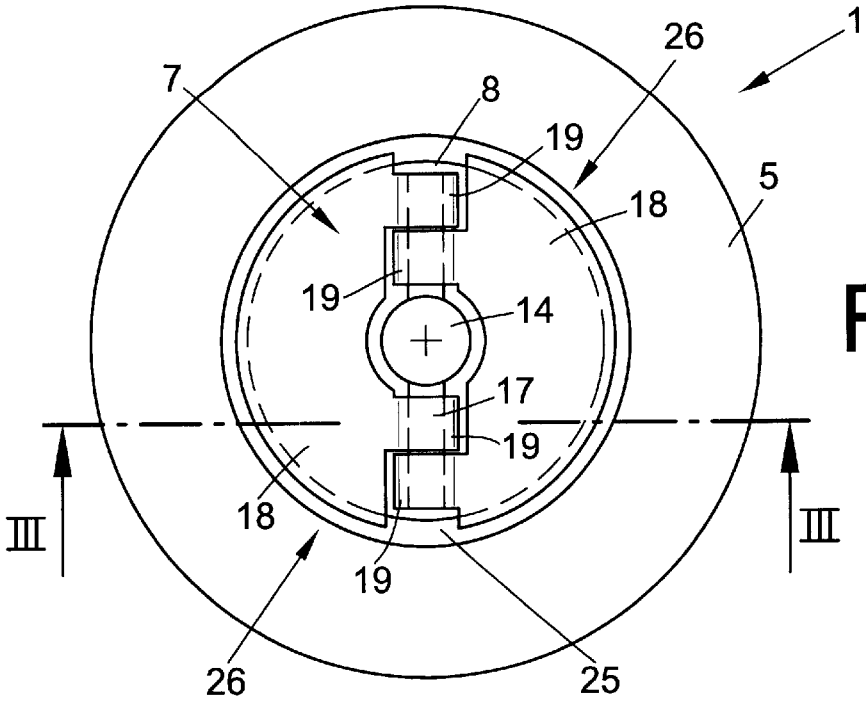
FIG. 2 is an end elevational view of the flanged wheel of the opening cylinder from the perspective of arrow X in FIG. 1.
Figure 3:
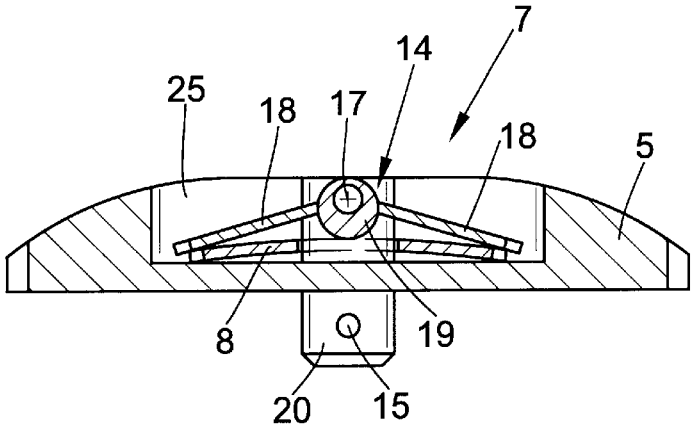
FIG. 3 is a cross-sectional view taken through the torque-free rapid tension device of the present invention along section line III—III in FIG. 2.
Figure 4:
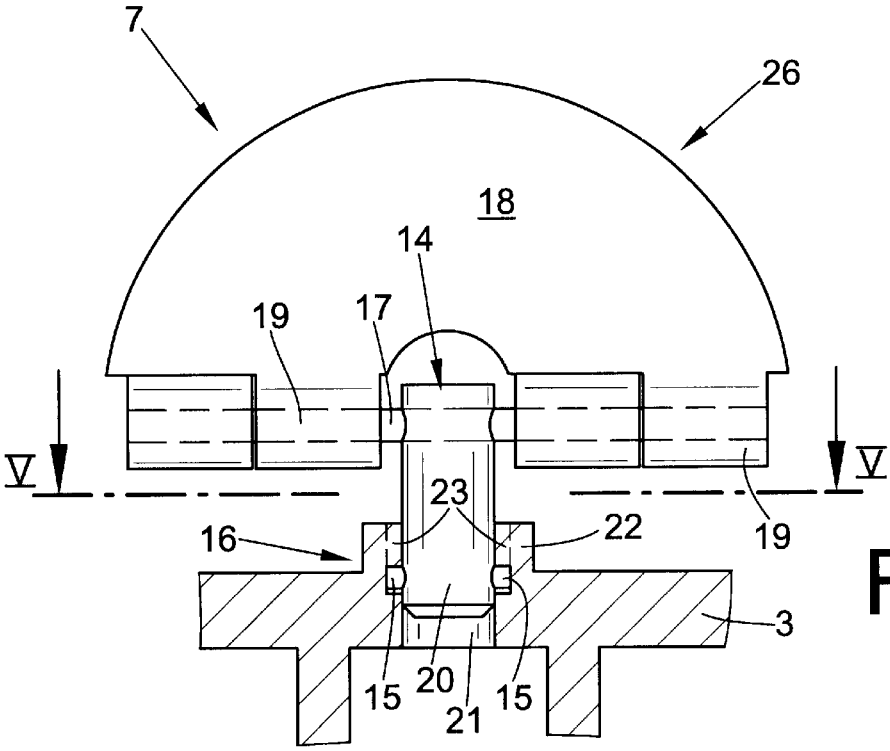
FIG. 4 is a side view of the torque-free rapid tension device of the present invention in a loosened state.

As is apparent in particular from FIGS. 2 to 4, torque-free rapid tension device 7 is comprised, e.g., of a bolt 14 having radial shoulders 15 for a bayonet catch 16 as well as a pivot shaft 17. Two actuating flaps 18 are pivotably mounted on bolt 14.

Actuating flaps 18 are connected to the bolt 14 via eccentrically mounted bores in clamping hubs 19 as well as via the pivot shaft 17.

Figure 5:
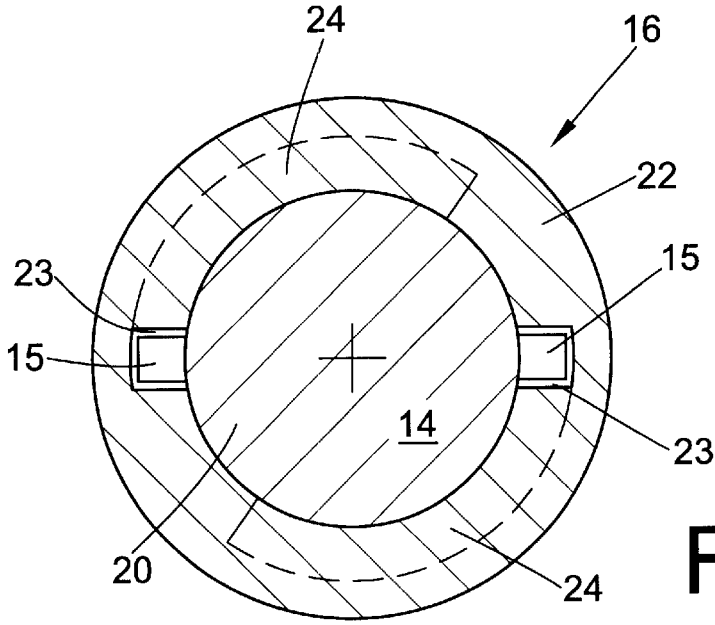
FIG. 5 is a cross-sectional view through the torque-free rapid tension device taken along section line V—V in FIG. 4 illustrating the bayonet catch device thereof.
Figure 6:
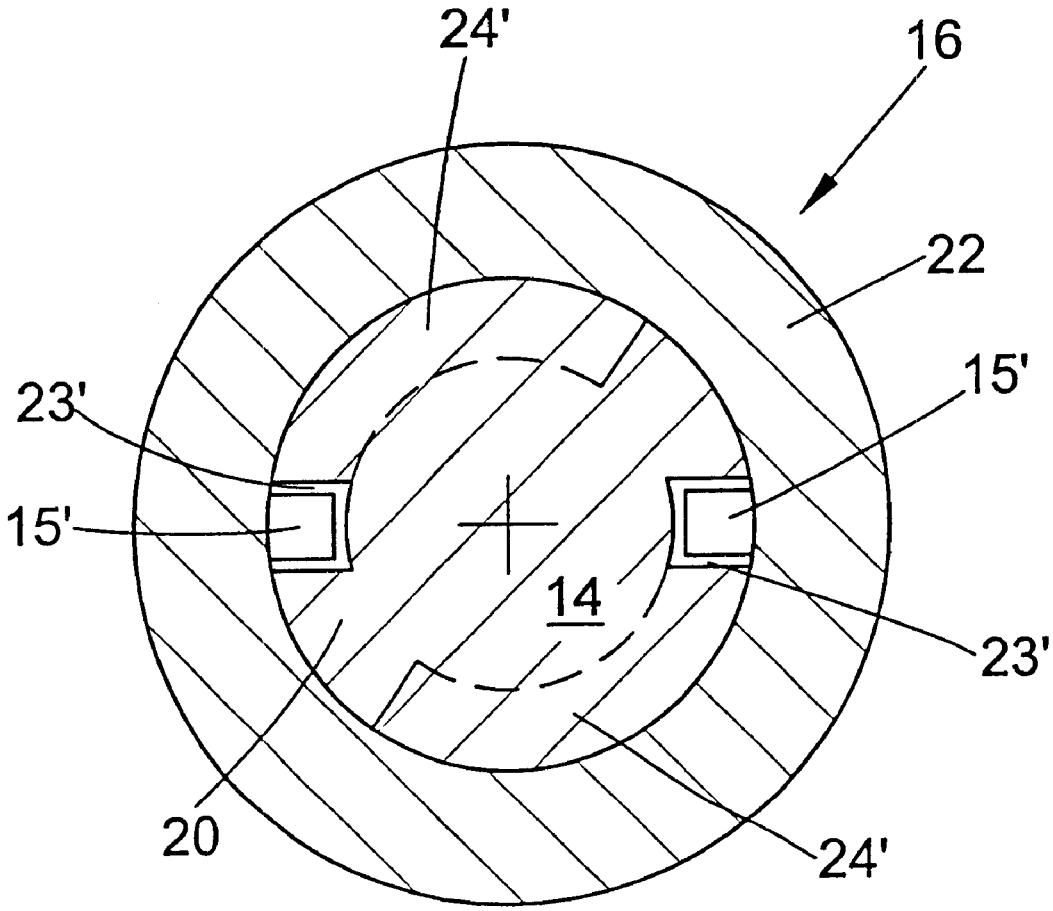
FIG. 6 is another cross-sectional view of the torque-free rapid tension device of the present invention similar to FIG. 5 but illustrating an alternative embodiment of the bayonet catch device.

The bolt 14 is supported by its cylindrical body 20 in a corresponding bore 21 of a collar-like shoulder 22 of the outside rotor 3 such that the bolt 14 can rotate to a limited degree. More specifically, as is depicted in one embodiment in FIG. 5, axial grooves 23 as well as helical grooves 24 are formed into the collar-like shoulder in which grooves the radial shoulders 15 of bolt 14 are guided, or as alternatively depicted in another embodiment if FIG. 6, the bolt 14 may itself be formed with radial and helical grooves 23' and 24' into which corresponding radial shoulders 15' of collar-like shoulder 22 engage. Thus, grooves 23, 24 or 23', 24' form, together with radial shoulders 15 or 15', a bayonet catch 16 that is a component of torque-free rapid tension device 7.

The operation of the present invention may thus be understood. In the operating state of the opening cylinder, as is indicated, e.g., in FIGS. 1, 2 and 3, actuation flaps 18 are pivoted outwardly and rest within central receiving bore 25 of flanged wheel 5 wherein the flaps are protected. This central receiving bore 25 can be additionally closed by a protective cap (not shown). In this position, the eccentrically supported clamping hubs 19 of eccentric clamps 26 load plate spring 8, that in turn resultantly acts with a component of axial force on the flanged wheel 5. Under the action of this axial force component, the toothed opening ring 2 is pressed against the annular shoulder 6 on the outside rotor 3 of the electric drive 4 and is thereby fixed in a non-positive manner.

In order to replace the toothed opening ring 2, the electric drive 4 is initially stopped by switching the energy source to the stator 12 to deactuate the delivery of operating current to the stator 12.

As soon as the opening cylinder 1 has thereafter slowed to a standstill, the actuating flaps 18 of the eccentric clamps 26 of the torque-free rapid tension device 7 are pivoted into the position indicated in FIG. 4 in which eccentrically supported clamping hubs 19 of eccentric clamps 26 are out of contact with plate spring 8. The eccentric clamps 26 are subsequently rotated, e.g., counterclockwise, via actuating flaps 18 until the radial shoulders 15 on the bolt 14 of the torque-free rapid tension device 7 correspond with the axial grooves 23 in the collar-like shoulder 22 of the outside rotor 3. The torque-free rapid tension device 7 can then be withdrawn from the bore 21 of the collar-like shoulder 22 of the outside rotor 3 and the flanged wheel 5 as well as the toothed opening ring 2 can be demounted. No tools are necessary to carry out the steps described above.

The mounting of a new toothed opening ring 2 takes place in the reverse order of these described steps. That is, after a new opening ring 2 has been placed about the outer circumference 27 of the outside rotor 3 of the electric drive 4, the flanged wheel 5 is positioned and the plate spring 8 is placed into central recess 25 of the flanged wheel 5. The torque-free rapid tension device 7 is then mounted. Specifically, the cylindrical body 20 of the bolt 14 is introduced into the bore 21 of the collar-like shoulder 22 of outside rotor 3 with its radial shoulders 15 aligned with the axial grooves 23 to slide axially thereinto. The bolt 14 is then rotated clockwise by the actuating flaps 13, which fixes the torque-free rapid tension device 7 on the outside rotor 3 of the electric drive 4. The actuating flaps 18 are then pivoted outwardly about the pivot shaft 17. The eccentrically supported clamping hubs 19 of the eccentric clamps 26 load the plate spring 8 during this pivoting movement, whereby the spring presses the flanged wheel 5 against the opening ring 2 and secures it in a non-positive manner.

The torque-free rapid tension device 7 as thusly described makes possible not only a smooth and rapid replacement of the opening ring 2 but also represents a very inexpensive and reliable fastening device.

The invention is not intended to be limited to the exemplary embodiment described and illustrated in the drawings. Modifications of individual structural components are clearly possible without departing from the general concept of the invention.

It is possible, for example, that each eccentric clamps 26 does not comprise two clamping hubs 19, as presented in the exemplary embodiment, but rather that only one clamping hub 19 is provided for each eccentric clamp 26 for loading the plate spring 8.

Moreover, it is also conceivable, for example, that instead of using plate spring 8 a comparable spring element, e.g., a helical spring or the like is used.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. An opening cylinder for an open-end spinning device, comprising an opening cylinder drive having a driven structural component supported for free rotation, an opening ring, and a torque-free rapid tension device for detachably securing the opening ring in a readily replaceable manner about the structural component, the torque-free rapid tension device and the driven structural component having mateable positively lockable connecting elements which are relatively moveable torque-free between an engaged disposition and a disengagement position, and the torque-free rapid tension device comprising a clamping device for non-positive securement of the connecting elements in the locked disposition.

2. The opening cylinder according to claim 1, characterized in that the opening cylinder drive comprises an electric motor, the structural component comprises a radially outward rotor of the motor, and the opening ring is fixed by the torque-free rapid tension device on the rotor.

3. The opening cylinder according to claim 1, characterized in that the opening cylinder comprises a flanged wheel and the torque-free rapid tension device comprises a spring element and two eccentric clamps acting on the spring element against the flanged wheel to fix the opening ring in a non-positive manner on the structural component.

4. The opening cylinder according to claim 3, characterized in that each of the eccentric clamps comprise at least one eccentrically supported clamping hub and a manually operable actuating flap.

5. The opening cylinder according to claim 3, characterized in that the torque-free rapid tension device further comprises a bolt, a catch device for securing the bolt to the structural component of the drive, and a pivot shaft for connecting the eccentric clamps to the bolt.

6. The opening cylinder according to claim 5, characterized in that the catch device comprises radial projections on the bolt and axial and helical grooves on the structural component for receiving the projections.

7. The opening cylinder according to claim 5, characterized in that the catch device comprises radial projections on the structural component and axial and helical grooves on the bolt for receiving the projections.

8. The opening cylinder according to claim 1, characterized in that the actuating flaps of the eccentric clamps are received in a central recess of the flanged wheel in an operating state of the opening cylinder.

9. The opening cylinder according to claim 1, characterized in that the opening ring and the flanged wheel are integrally connected as a unit.

* * * * *